US006219522B1

(12) United States Patent
Ishizuka et al.

(10) Patent No.: US 6,219,522 B1
(45) Date of Patent: Apr. 17, 2001

(54) FUSER AND IMAGE FORMING APPARATUS

(75) Inventors: Jiro Ishizuka, Numazu; Naoyuki Yamamoto, Shizuoka-ken, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/396,460

(22) Filed: Sep. 15, 1999

(30) Foreign Application Priority Data

Sep. 17, 1998 (JP) ..... 10-263465

(51) Int. Cl.[7] ..... G03G 15/20
(52) U.S. Cl. ..... 399/333
(58) Field of Search ..... 399/333, 320, 399/328, 330, 331; 219/216; 430/98, 99; 432/60; 492/53, 56

(56) References Cited

U.S. PATENT DOCUMENTS

| | | | | |
|---|---|---|---|---|
| 2,297,691 | | 10/1942 | Carlson . | |
| 4,949,130 | * | 8/1990 | Torino | 399/327 |
| 5,608,508 | | 3/1997 | Kumagai et al. | 399/339 |
| 5,724,638 | * | 3/1998 | Isogai et al. | 399/333 |
| 5,903,799 | | 5/1999 | Saito et al. | 399/69 |
| 5,966,578 | | 10/1999 | Soutome et al. | 399/333 |

FOREIGN PATENT DOCUMENTS

| | | |
|---|---|---|
| 42-23910 | 11/1942 | (JP) . |
| 43-24748 | 10/1943 | (JP) . |
| 52-003304 | 1/1977 | (JP) . |
| 57-52574 | 3/1982 | (JP) . |
| 60-217366 | 10/1985 | (JP) . |
| 60-252360 | 12/1985 | (JP) . |
| 60-252361 | 12/1985 | (JP) . |
| 61-94062 | 5/1986 | (JP) . |
| 61-138259 | 6/1986 | (JP) . |
| 61-273554 | 12/1986 | (JP) . |
| 62-014166 | 1/1987 | (JP) . |
| 1-109359 | 4/1989 | (JP) . |
| 2-79860 | 3/1990 | (JP) . |
| 3-050559 | 3/1991 | (JP) . |

* cited by examiner

*Primary Examiner*—Sophia S. Chen
*Assistant Examiner*—Hoan Tran
(74) *Attorney, Agent, or Firm*—Fitzpatrick, Cella, Harper & Scinto

(57) ABSTRACT

An image forming apparatus has improved follow-up properties of the fixing rollers between a surface resin layer and an elastic layer beneath it, thereby preventing the generation of a crack and allowing discharge of OHP sheets in a satisfactory manner. A fixing roller and a pressurizing roller are in press contact with each other, and a recording material having an unfixed image is press-conveyed by a pressurizing portion formed by the pair of rollers to effect heat fixing of the image on the recording material. The fixing roller has an elastic layer having a thickness of 1 mm or more and a resin layer having a thickness of 20 $\mu$m to 50 $\mu$m formed on the surface of the elastic layer by firing, and the coefficient of linear expansion of the elastic layer at 150° C. is not larger than 2.7 times the coefficient of linear expansion of the resin layer at 150° C.

5 Claims, 4 Drawing Sheets

FUSER AND IMAGE FORMING APPARATUS

BACKGROUND OF THE INVENTION

1. Field of the Invention

The present invention relates to a fuser suitable for thermal fusing for use in electrophotography, electrostatic recording methods, and magnetic recording methods, and the present invention also relates to an image forming apparatus using a toner for electrostatic image development.

2. Description of the Related Art

Hitherto, various methods of electrophotography are known, as disclosed, for example, in U.S. Pat. No. 2,297,691, Japanese Patent Publication No. 42-23910, and Japanese Patent Publication No. 43-24748. Generally speaking, an electrostatic latent image is formed on a photosensitive member by various means by utilizing a photoelectric material. Then, the latent image is developed by using toner, and the toner image is transferred to a transfer material such as paper by using a direct or indirect means as necessary. After this, the image is fixed by heating, application of pressure, thermal-pressurizing, or solvent vapor to thereby produce a copy. The toner remaining on the photosensitive member is removed by cleaning using various methods, and the above process is then repeated.

Furthermore, a general method for forming a full color image will be described. The photosensitive member of a photosensitive drum is uniformly charged by a primary charger, and image exposure is effected by a laser beam modulated by a magenta image signal of the original to form an electrostatic latent image on the photosensitive drum; the development of the latent image is then performed by a magenta developing device containing magenta toner to form a magenta toner image. Next, the magenta toner image developed on the photosensitive drum is transferred to a conveyed transfer material by a direct or indirect means using a transfer charger.

The photosensitive drum on which the development of the electrostatic latent image has been produced is subjected to charge dissipation by means of a charger for charge dissipation, and to cleaning by a cleaning means. Then, it is charged by the primary charger again, and the formation of a cyan toner image and the transfer of the cyan toner image to the transfer material, to which the magenta toner image has been transferred, is effected. Furthermore, similar processes are conducted successively using yellow and black toners to transfer four-color toner images to the transfer material. Fixing of the images to the transfer material having the four-color toner images is effected by heat and pressure using a fixing roller to thereby form a full color image.

Recently, such an apparatus is used not only as a copying machine for office use for simply copying an original but also as a printer for printing the output of a computer or as a personal copying machine.

In addition to laser printers, such apparatuses are rapidly being developed as printers for facsimile apparatuses using ordinary paper in which a basic engine is used.

As a result, a reduction in size and weight, an increase in speed, and an improvement in image quality and reliability are strongly demanded, and the components of such apparatuses have become simplified. Improved performance is required of the toner since no superior apparatus is possible without achieving an improvement in the performance of the toner. Furthermore, recently, various types of copying are necessary, and the demand for color copying is rapidly increasing. To copy the original color image more faithfully, a further improvement in image quality and resolution is required. From these viewpoints, it is necessary for the toner used in the color image forming method to exhibit satisfactory melting and mixing properties when heat is applied thereto, and it is desirable to use a toner having a low softening point, a low melting viscosity, and a high rapid melt property.

By using such a rapid melt toner, it is possible to widen the color reproduction range of copies and to obtain a color copy true to the original image.

However, generally speaking, such a color toner having a high rapid melt property has a great affinity for the fixing roller and tends to be offset on the fixing roller at the time of fixing.

In particular, in the case of the fuser of a color image forming apparatus, a plurality of toner layers of magenta, cyan, yellow, and black is formed on the transfer material, so that offsetting is liable to occur due to the increase in the number of toner layers.

Conventionally, for the purpose of preventing the toner from adhering to the surface of the fixing roller, the roller surface is formed, for example, of a material superior in release property with respect to toner, such as silicone rubber or fluoro rubber, and furthermore, to prevent offsetting and wear of the roller surface, the roller surface is coated with a thin film of a liquid having high release properties such as silicone oil or fluorine oil. In this case, the releasing agent and the roller surface are materials having great affinities. However, although this method is very effective in preventing offsetting of the toner, it is necessary to provide a device for supplying an offset preventing liquid, so that the fixing device is complicated. Furthermore, the application of this oil leads to mutual separation of the layers constituting the fixing roller, with the result that the service life of the fixing roller is shortened. The transfer material to which a toner image is transferred by using a fuser consists, generally, of various types of paper, coating paper, plastic film or the like. Above all, attention has recently focused on the need for a transparency film (OHP film) for use in an overhead projector for presentation purposes. Unlike paper, OHP film sheets are rather poor in oil absorbing capacity, so that the copy OHP sheets available at present are inevitably sticky when oil is applied thereto, which leads to rather poor quality of the obtained image. Furthermore, it is quite possible that the silicone oil, etc. will evaporate due to heat, thereby contaminating the interior of the apparatus, causing a problem of processing the recovered oil. In view of this, a method has been proposed according to which, instead of using a silicone oil supplying device, a releasing agent such as low molecular weight polyethylene or low molecular weight polypropylene is added to the toner so that an offset preventing liquid may be supplied from the toner during heating. However, if a great amount of this additive is added to achieve a satisfactory effect, filming of the photosensitive member occurs or the surface of the toner holding member such as the carrier and sleeve is contaminated, resulting in a deterioration in the image quality. In view of this, an amount of releasing agent, which is small enough not to deteriorate the image quality, is added to the toner, and some releasing oil is supplied or a device of the type which takes up the offset toner by using, for example, a web-like member is used, or a device which performs cleaning by using a cleaning pad is used.

It is well known in the art to add some wax to the toner as a releasing agent, as disclosed in, for example, Japanese Patent Publication No. 52-3304, Japanese Patent Publication No. 52-3305, and Japanese Patent Laid-Open No. 57-52574.

Furthermore, techniques in which wax or the like is added to the toner are disclosed in, for example, Japanese Patent Laid-Open No. 3-50559, Japanese Patent Laid-Open No. 2-79860, Japanese Patent Laid-Open No. 1-109359, Japanese Patent Laid-Open No. 62-14166, Japanese Patent Laid-Open No. 61-273554, Japanese Patent Laid-Open No. 61-94062, Japanese Patent Laid-Open No. 61-138259, Japanese Patent Laid-Open No. 60-252361, Japanese Patent Laid-Open No. 60-252360, and Japanese Patent Laid-Open No. 60-217366.

By using a toner containing wax, it is possible to prevent offset without having to apply a releasing agent to the surface of the roller as in the conventional art. Thus, the material of the surface of the fixing roller is not restricted to one having great affinity for the releasing agent. That is, in the case of the conventional rapid melt toner, the roller surface conventionally consists of silicone rubber or fluoro rubber. These involve problems with respect to wear resistance, strength, etc. When the number of copies to be made is high, flaws are generated on the surface of the roller, resulting in defective images. By using a toner containing wax, it is possible to use a fluoro resin, which is superior in wear resistance and releasing property, as the material of the roller surface layer.

However, using a fixing roller coated with such a fluoro resin produces the following problem.

The surface of such a roller coated with fluoro resin is harder than the surface of a conventional roller whose surface layer is an elastic layer, so that deformation of the surface of the fixing roller occurs to a smaller degree than in the case of the elastic layer roller, and the discharge direction of the recording material is higher in the case of a fluororesin coated roller than in the case of the conventional roller. When the discharge direction is higher, there is unevenness in gloss, or the recording material may be wound around the fixing roller, depending on the kind of recording material. In particular, when performing fixing on OHP film, it is necessary to conduct fixing at lower speeds in order to improve transmissivity, and the film may become easily wound around the fixing roller. In view of this, an elastic layer is provided beneath the surface fluoro resin layer to increase the thickness to thereby soften the fixing roller and increase the amount of deformation, whereby paper discharge is effected in a stable manner below the horizontal direction.

However, when a fixing roller constructed as described above is used, the surface resin layer cannot follow the elastic layer beneath it due to the difference in coefficient of linear expansion between the elastic layer and the surface resin layer, so that when the number of copies to be made increases and the surface resin deteriorates, cracks are generated in the surface resin, resulting in defective images. This is likely to occur when the thickness of the elastic layer is relatively large.

SUMMARY OF THE INVENTION

Accordingly, it is an object of the present invention to provide a fuser in which the above problems in the prior art have been overcome and in which no cracks are generated in the surface resin of the fixing roller, and an image forming apparatus using this fuser.

The above object is achieved by the following means.

In a first aspect of the present invention, there is provided a fuser of the type which has a pair of rollers which are arranged so as to be rotatable while being in press contact with each other and which consist of a fixing roller and a pressurizing roller, a recording material having an image which has not undergone fixing being press-conveyed by a pressurizing portion formed by the pair of rollers to effect heat fixing of the image on the recording material, wherein the fixing roller has an elastic layer having a thickness of 1 mm or more and a resin layer having a thickness of 20 $\mu$m to 50 $\mu$m formed on the surface of the elastic layer by firing, and wherein the coefficient of linear expansion of the elastic layer at 150° C. is not larger than 2.7 times the coefficient of linear expansion of the resin layer at 150° C.

In a second aspect of the present invention, there is provided a fuser of the type which has a pair of rollers which are arranged so as to be rotatable while being in press contact with each other and which consist of a fixing roller and a pressurizing roller, a recording material having an image which has not undergone fixing being press-conveyed by a pressurizing portion formed by the pair of rollers to effect heat fixing of the image on the recording material, wherein the fixing roller has an elastic layer having a thickness of 1 mm to 3 mm and a resin layer formed on the surface of the elastic layer by firing, and wherein the thickness of the resin layer is 60 $\mu$m to 100 $\mu$m.

In a third aspect of the present invention, there is provided a fuser of the type which has a pair of rollers which are arranged so as to be rotatable while being in press contact with each other and which consist of a fixing roller and a pressurizing roller, a recording material having an image which has not undergone fixing being press-conveyed by a pressurizing portion formed by the pair of rollers to effect heat fixing of the image on the recording material, wherein the fixing roller has an elastic layer having a thickness of 1 mm or more and a resin layer having a thickness of 20 $\mu$m to 50 $\mu$m formed on the surface of the elastic layer by firing, wherein there is provided between the elastic layer and the resin layer at least one elastic layer having a coefficient of linear expansion which is somewhere between the coefficient of linear expansion of the elastic layer at 150° C. and the coefficient of linear expansion of the resin layer at 150° C., and wherein the coefficient of linear expansion of the adjacent inner layer at 150° C. is not larger than 2.7 times the coefficient of linear expansion of the adjacent outer layer at 150° C.

In a fourth aspect of the present invention, there is provided a fuser of the type which has a pair of rollers which are arranged so as to be rotatable while being in press contact with each other and which consist of a fixing roller and a pressurizing roller, a recording material having an image which has not undergone fixing being press-conveyed by a pressurizing portion formed by the pair of rollers to effect heat fixing of the image on the recording material, wherein the fixing roller has an elastic layer having a thickness of 1 mm or more and a resin layer having a thickness of 20 $\mu$m to 50 $\mu$m formed on the surface of the elastic layer by firing, and wherein there is provided between the elastic layer and the resin layer at least one elastic layer having a hardness of 75 degrees or more of JIS-A standard. In the first aspect of the present invention, the coefficient of linear expansion of the elastic layer at 150° C. is preferably not larger than $4.0\times10E^{-4}$ cm/cm·° C. In the third aspect of the present invention, the coefficient of linear expansion at 150° C. of the elastic layer spaced apart from the resin layer is preferably not smaller than 2.7 times and not larger than 3.4 times the coefficient of linear expansion of the resin layer at 150° C., and the coefficient of linear expansion of the elastic layer adjacent to the resin layer is not larger than $4.0\times10E^{-4}$ cm/cm·° C.

In the present invention, by setting the relationship between the resin layer and the elastic layer as described above, it is possible to improve the follow-up property between the surface resin layer and the elastic layer beneath it, prevent the generation of a crack and discharge OHP sheets in a satisfactory manner.

DESCRIPTION OF THE PREFERRED EMBODIMENTS

In the first aspect of the present invention, there is provided a fuser of the type which has a pair of rollers which are arranged so as to be rotatable while being in press contact with each other and which consist of a fixing roller and a pressurizing roller, a recording material having an image which has not undergone fixing being press-conveyed by a pressurizing portion formed by the pair of rollers to effect heat fixing of the image on the recording material, wherein the fixing roller has an elastic layer having a thickness of 1 mm or more and a resin layer having a thickness of 20 $\mu$m to 50 $\mu$m formed on the surface of the elastic layer by firing, and wherein the coefficient of linear expansion of the elastic layer at 150° C. is not larger than 2.7 times the coefficient of linear expansion of the resin layer, whereby it is possible to improve the follow-up property between the surface resin layer and the elastic layer beneath it, prevent the generation of a crack and discharge OHP sheets in a satisfactory manner.

Figure 1:
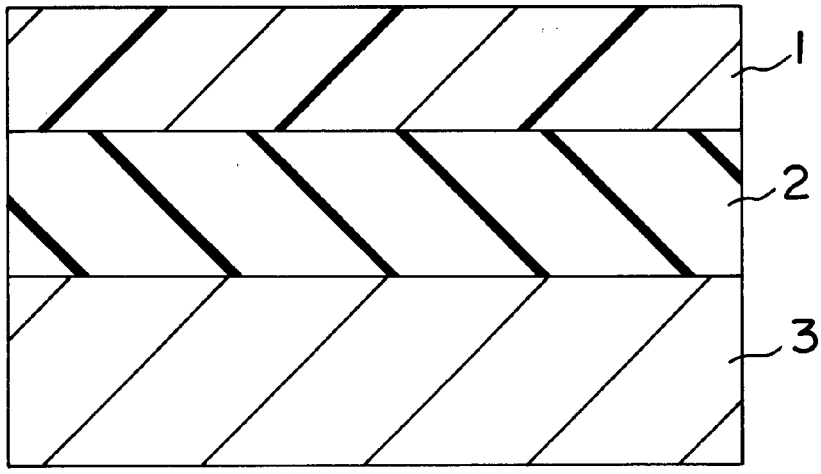
FIG. 1 is a sectional view showing an example of the fixing roller used in the fuser of the present invention.

FIG. 1 is a sectional view showing an example of the fixing roller used in the fuser of the present invention.

As shown in FIG. 1, in the fixing roller of the first aspect of the present invention, a surface layer 1 is provided on a core metal 3 through the intermediation of an elastic layer 2.

The core metal 3 consists of aluminum, iron, etc., and has a thickness preferably ranging from 1 to 10 mm.

The elastic layer 2 may be formed of HTV silicone rubber, LTV silicone rubber or the like, and it has a thickness preferably ranging from 1 mm to 3 mm.

Examples of the material of the surface layer 1 include PTFE (tetrafluoroethylene), FEP (tetrafluoroethylene-hexafloropropyrene copolymer, and PFA (tetrafluoroethylene-perfloroalkylvinylether copolymer. When the thickness of the elastic layer 2 is not smaller than 1 mm and not larger than 3 mm, it is important that the thickness of the surface layer 1 should range from 20 $\mu$m to 50 $\mu$m. When the thickness of the surface layer 1 is less than 20 $\mu$m, unevenness is liable to be generated in the surface layer 1, and the surface of the roller deteriorates, resulting in a defective image. When the thickness of the surface layer 1 is more than 50 $\mu$m, the period of firing at high temperature when producing the roller becomes long, resulting in a deterioration in the elastic layer 2, an increase in the roller cost, etc.

In this case, it is important that the coefficient of linear expansion of the elastic layer 2 at 150° C. should not be larger than 2.6 times the coefficient of linear expansion of the surface layer 1 at 150° C.

Further, in the second aspect of the present invention, there is provided a fuser of the type which has a pair of rollers which are arranged so as to be rotatable while being in press contact with each other and which consist of a fixing roller and a pressurizing roller, a recording material having an image which has not undergone fixing being press-conveyed by a pressurizing portion formed by the pair of rollers to effect heat fixing of the image on the recording material, wherein the fixing roller has an elastic layer having a thickness of 1 mm to 3 mm and a resin layer formed on the surface of the elastic layer, and wherein the thickness of the resin layer is 60 $\mu$m to 100 $\mu$m, whereby it is possible to restrain thermal expansion of the elastic layer by the surface resin, so that it is possible to prevent generation of a crack and discharge OHP sheets in a satisfactory manner.

Next, in the second aspect of the present invention, the thickness of the fixing roller 2 is 1 mm to 3 mm. In this case, it is important that the thickness of the surface resin layer 1 should range from 60 $\mu$m to 100 $\mu$m. When the thickness of the surface layer 1 is less than 60 $\mu$m, it is impossible to restrain the thermal expansion of the elastic layer 2, and the generation of a crack in the surface layer 1 cannot be prevented. On the other hand, when the thickness of the surface layer 1 is more than 100 $\mu$m, the heat conduction deteriorates, and heat supply from inside deteriorates.

Further, in the third aspect of the present invention, there is provided a fuser of the type which has a pair of rollers which are arranged so as to be rotatable while being in press contact with each other and which consist of a fixing roller and a pressurizing roller, a recording material having an image which has not undergone fixing being press-conveyed by a pressurizing portion formed by the pair of rollers to effect heat fixing of the image on the recording material, wherein the fixing roller has an elastic layer having a thickness of 1 mm or more and a resin layer having a thickness of 20 $\mu$m to 50 $\mu$m formed on the surface of the elastic layer by firing, wherein there is provided at least one elastic layer having a coefficient of linear expansion which is somewhere between the coefficient of linear expansion of the elastic layer at 150° C. and the coefficient of linear expansion of the resin layer at 150° C., and wherein the coefficient of linear expansion of the adjacent inner layer at 150° C. is not larger than 2.7 times the coefficient of linear expansion of the adjacent outer layer at 150° C., whereby it is possible to improve the follow-up property between the surface resin layer and the elastic layer beneath it, prevent the generation of a crack and discharge OHP sheets in a satisfactory manner.

It is important that the coefficient of linear expansion of the elastic layer at 150° C. is not larger than 2.7 times the coefficient of linear expansion of the surface resin layer 1 at 150° C. When the coefficient of linear expansion of the elastic layer at 150° C. is larger than 2.7 times the coefficient of linear expansion of the surface resin layer 1 at 150° C., a crack is generated in the surface layer 1, which is not desirable.

Further, when the thickness of the elastic layer 2 of the fixing roller is 1 mm to 3 mm, it is important that the thickness of the surface resin layer 1 should be 60 $\mu$m to 100 $\mu$m. When the thickness of the surface layer 1 is less than 60 $\mu$m, it is impossible to restrain the thermal expansion of the elastic layer 2, and the generation of a crack in the surface layer 1 cannot be prevented. On the other hand, when the thickness of the surface layer 1 is more than 100 $\mu$m, the heat conduction deteriorates, and heat supply from inside deteriorates, which is not desirable.

Figure 2:
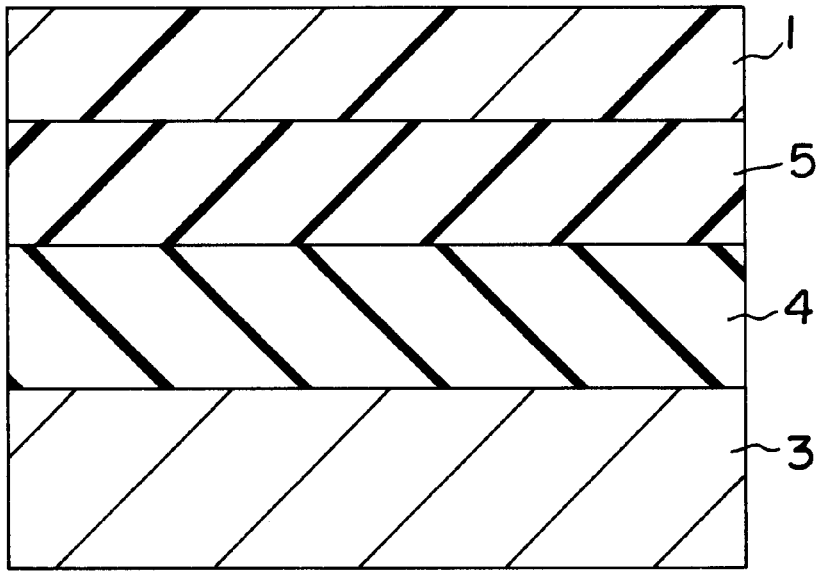
FIG. 2 is a sectional view showing another example of the fixing roller used in the fuser of the present invention.

FIG. 2 shows another example the fixing roller. In this example, the surface layer 1 is provided on the core metal 3 through the intermediation of the lower elastic layer 4 and an intermediate elastic layer 5. It is possible to provide two or more elastic layers.

In this case, the materials of the core metal 3 and the surface layer 1 are the same as those in the case of FIG. 1. Examples of the material of the lower elastic layer 4 include fluoro rubber, silicone rubber, etc. FIG. 2 is a sectional view showing another example of the fixing roller.

As shown in FIG. 2, in the third aspect of the invention, the surface layer 1 is provided on the core metal 3 through the intermediation of the lower elastic layer 4 and an intermediate elastic layer 5. It is possible to provide two or more intermediate elastic layers 5.

The materials of the core metal 3 and the surface layer 1 are the same as those of the fixing roller 1 of FIG. 1.

Examples of the material of the lower elastic layer 4 include fluoro rubber, silicone rubber, etc. Examples of the material of the intermediate elastic layer 5 include a mixture of fluoro rubber and PFA, FEP, etc.

In this case, the thickness of the lower elastic layer 4 is preferably not less than 1 mm and not more than 3 mm, and the thickness of the intermediate elastic layer 5 is preferably not less than 10 $\mu$m and not more than 100 $\mu$m.

In this case, the surface layer 1 is formed by firing a resin layer having a thickness of 20 $\mu$m to 50 $\mu$m.

It is important that the coefficient of linear expansion of the intermediate elastic layer 5 at 150° C. should be somewhere between the coefficient of linear expansion of the lower elastic layer 4 at 150° C. and that of the surface layer 1 at 150° C., and that the coefficient of linear expansion of the adjacent inner elastic layer 4 at 150° C. should not be larger than 2.6 times the coefficient of linear expansion of the adjacent outer intermediate elastic layer 5 at 150° C.

Further, in the fourth aspect of the present invention, there is provided a fuser of the type which has a pair of rollers which are arranged so as to be rotatable while being in press contact with each other and which consist of a fixing roller and a pressurizing roller, a recording material having an image which has not undergone fixing being press-conveyed by a pressurizing portion formed by the pair of rollers to effect heat fixing of the image on the recording material, wherein the fixing roller has an elastic layer having a thickness of 1 mm or more and a resin layer having a thickness of 20 $\mu$m to 50 $\mu$m formed on the surface of the elastic layer by firing, and wherein there is provided between the elastic layer and the resin layer at least one elastic layer having a hardness of 75 degrees or more of JIS-A standard, whereby it is possible to improve the follow-up property between the surface resin layer and the elastic layer beneath it, prevent the generation of a crack and discharge OHP sheets in a satisfactory manner.

Further, according to a fifth aspect of the present invention, in the first through fourth aspects of the invention, the coefficient of linear expansion of the elastic layer at 150° C. is preferably not larger than $4.0\times10E^{-4}$ cm/cm·° C., whereby it is possible to improve the follow-up property between the surface resin layer and the elastic layer beneath it, prevent the generation of a crack and discharge OHP sheets in a satisfactory manner.

Further, according to a sixth aspect of the present invention, in the second through fourth aspect of the invention, the coefficient of linear expansion at 150° C. of the elastic layer is not smaller than 2.7 times and not larger than 3.4 times the coefficient of linear expansion of the resin layer at 150° C., and is not larger than $4.0\times10E^{-4}$ cm/cm·° C., whereby it is possible to improve the follow-up property between the surface resin layer and the elastic layer beneath it, prevent the generation of a crack and discharge OHP sheets in a satisfactory manner.

The fuser of the present invention is applicable to conventional image forming apparatuses.

Figure 3:
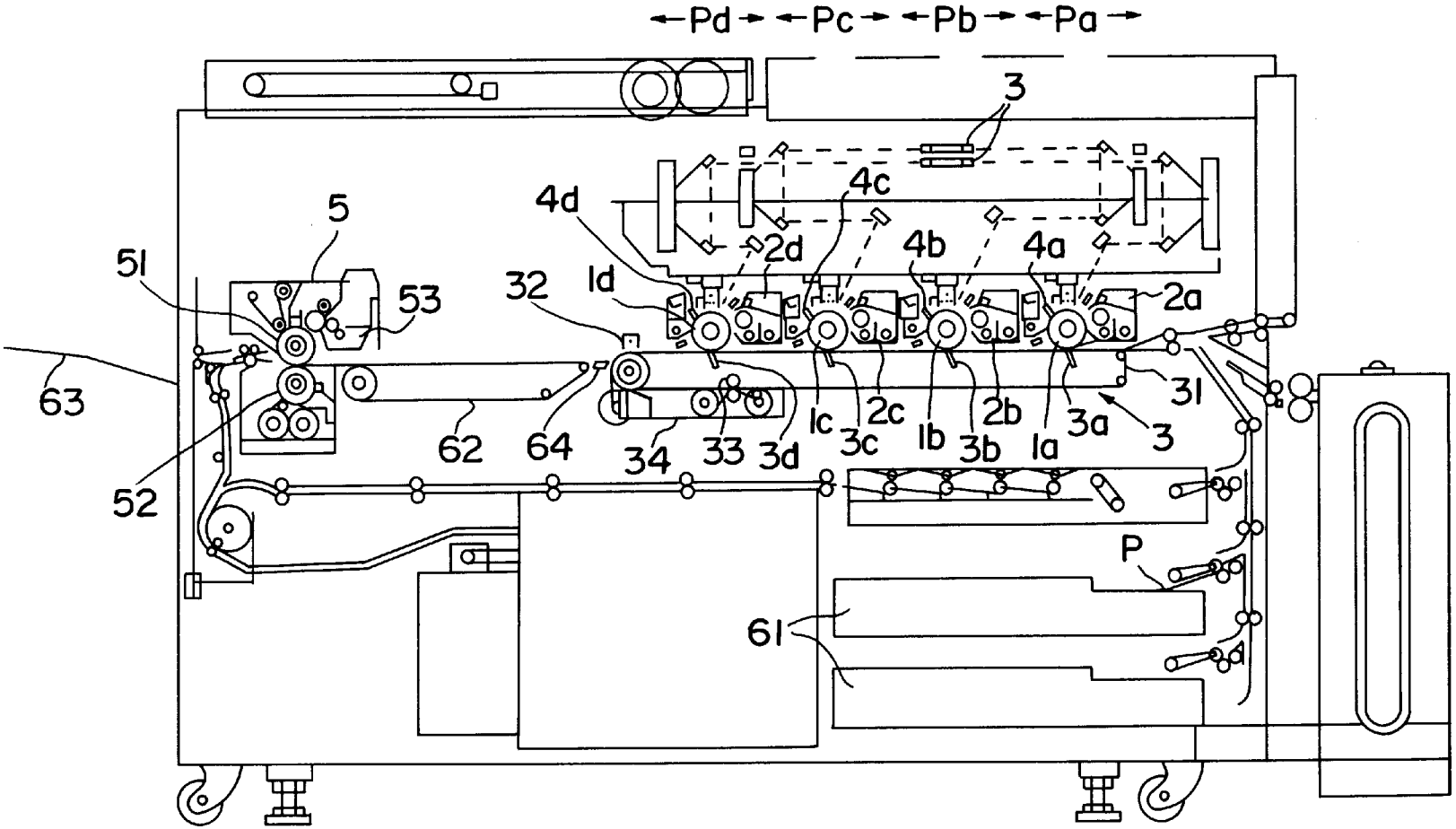
FIG. 3 PRIOR ART
FIG. 3 is a schematic sectional view of a conventional full color copying machine.
Figure 4:
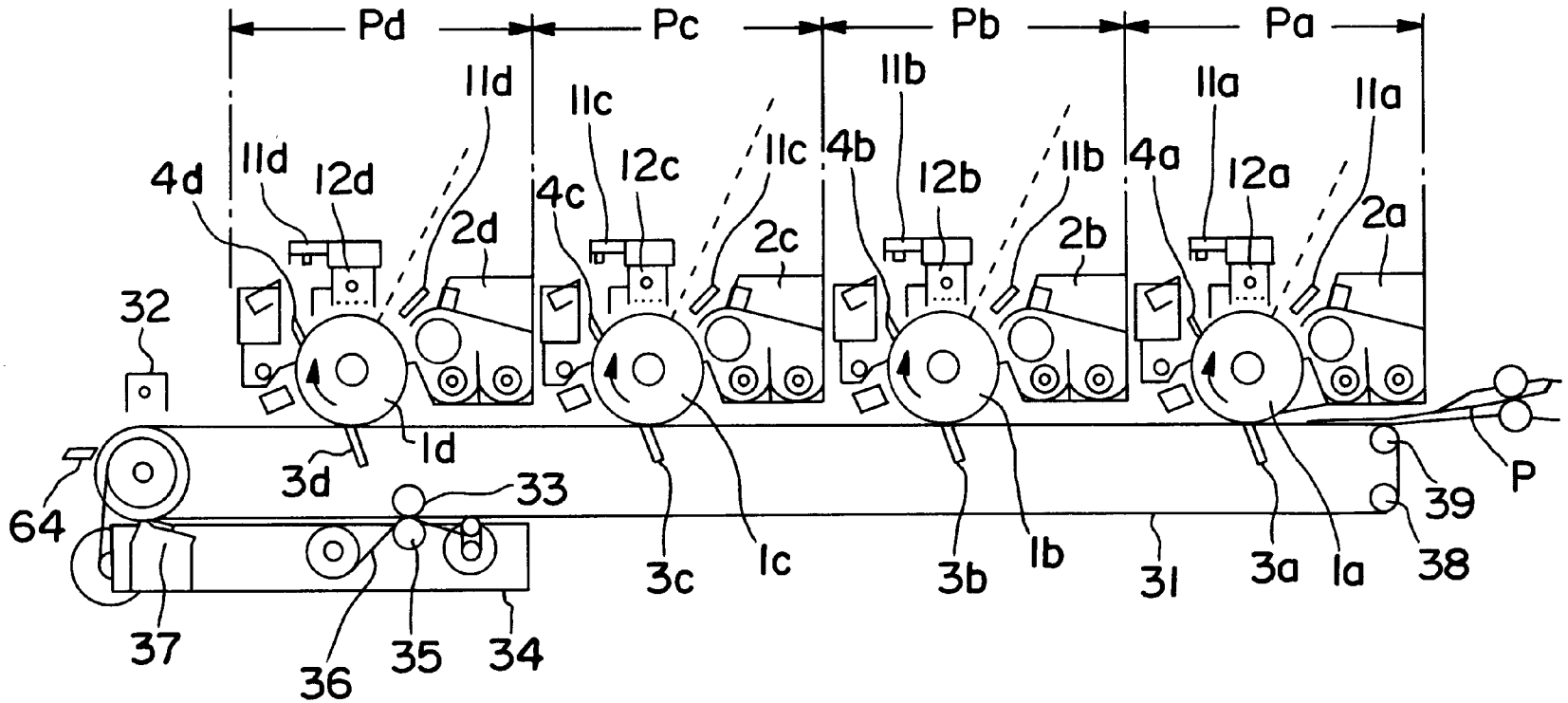
FIG. 4 PRIOR ART
FIG. 4 is a schematic sectional view of a conventional full color copying machine.
Figure 5:
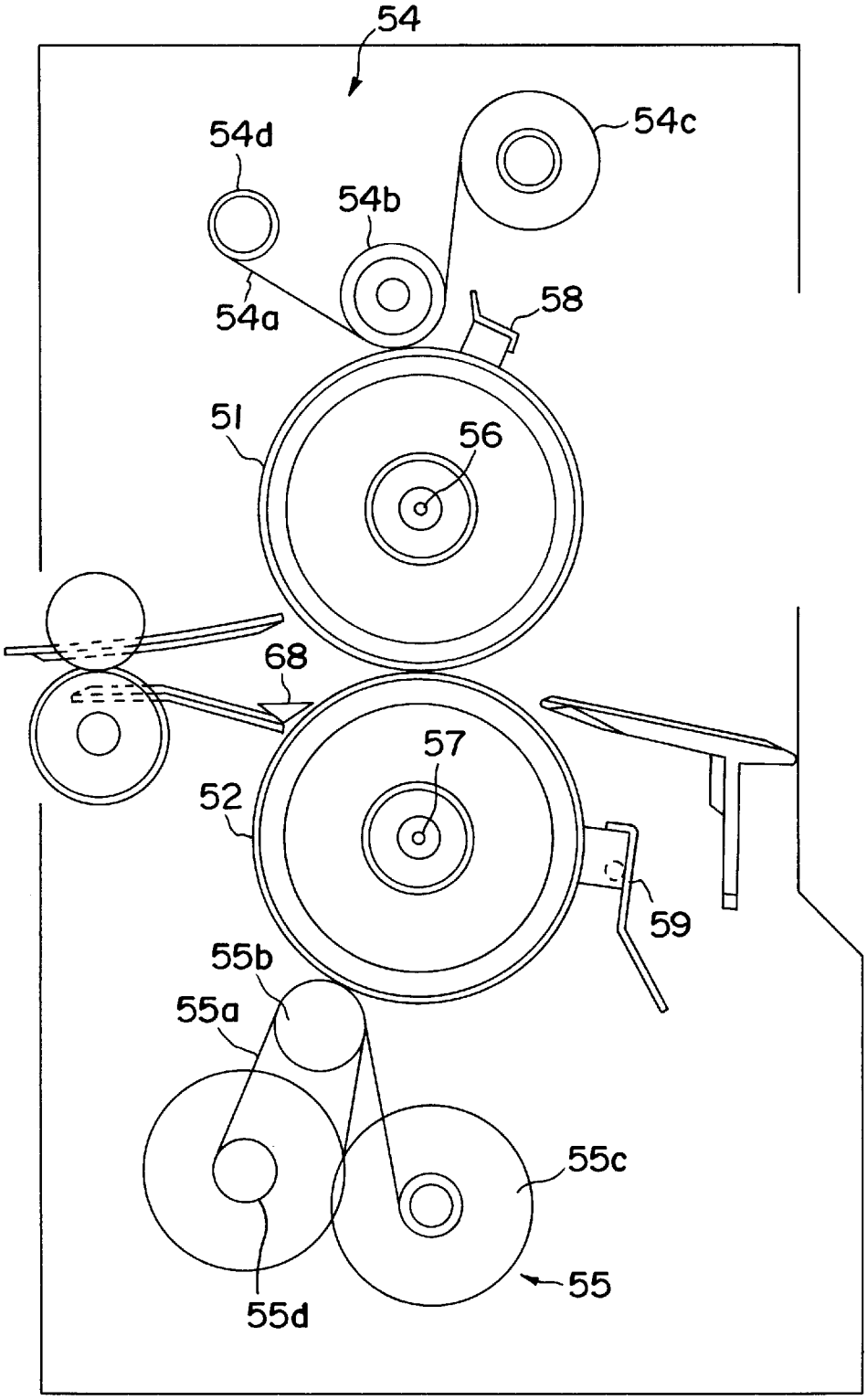
FIG. 5 PRIOR ART
FIG. 5 is a schematic sectional view of the fuser in the conventional full color copying machine.

As an example of such image forming apparatuses, FIGS. 3 through 5 show a full color copying machine having a plurality of optical scanning means. FIG. 3 is a sectional view of a full color copying machine, FIG. 4 is an enlarged view of an image forming section of FIG. 3, and FIG. 5 is an enlarged view of a fixing section of FIG. 3.

First, the full color copying machine will be briefly described with reference to FIGS. 3 through 5.

As shown in FIG. 3, there are provided four image forming stations serving as the image forming means, each image forming station comprising an electrophotographic photosensitive member serving as a latent image carrier (hereinafter referred to as "photosensitive drum"), developing device, etc. An image on the photosensitive drum formed in each image forming station is transferred to a recording material such as paper (hereinafter referred to as transfer paper) P which is on a conveying means adjacent to each photosensitive drum and passing by it.

Above the image forming stations, there is provided a reader section for reading the original with a photoelectric conversion device such as CCD.

As shown in FIG. 4, photosensitive drums 1*a*, 1*b*, 1*c* and 1*d* are arranged in the image forming stations Pa, Pb, Pc and Pd for forming magenta, cyan, yellow and black images, respectively, each photosensitive drum being rotatable in the direction of the arrow. Further, around the photosensitive drums 1*a*, 1*b*, 1*c* and 1*d*, there are arranged chargers 12*a*, 12*b*, 12*c* and 12*d*, laser scanning sections, developing devices 2*a*, 2*b*, 2*c* and 2*d*, and cleaners 4*a*, 4*b*, 4*c* and 4*d*, which are arranged in that order in the direction in which the photosensitive drums rotate. Below the photosensitive drums, transfer sections 3 are arranged. The transfer sections 3 have a transfer belt 31, which is a recording material conveying means common to the image forming stations, and transfer chargers 3*a*, 3*b*, 3*c* and 3*d*.

In the copying machine constructed as described above, the transfer paper P supplied from a paper feeding cassette 61 serving as recording material supplying means shown in FIGS. 3 and 4, is supported on the transfer belt 31 and conveyed to each image forming station, the wax containing toner images of different colors formed on the photosensitive drums being successively transferred.

When this transfer process is completed, the paper P is separated from the transfer belt 31 and conveyed to the fuser 5 by a conveying belt 62 serving as the recording material guiding means.

As shown in detail in FIG. 5, the fuser comprises a fixing roller 51 serving as a rotating member for fixing that is rotatably arranged, a pressurizing roller 52 serving as a rotating member for pressurization adapted to rotate while in press contact with the fixing roller 51, and roller cleaning devices 54 and 55.

The fixing roller 51 comprises a core metal of aluminum or iron, a lower layer formed on the core metal and consisting of HTV (high temperature vulcanizing) type silicone rubber, and a fluororesin surface layer provided thereon through the intermediation of an adhesive. The material of the fluororesin surface layer may be tetrafluoroethylene (PTFE), tetrafluoroethylene-hexafloropropylene copolymer (FEP), tetrafluoroethylene-perfloro (alkylvinylether) copolymer (PFA), etc. A roller coated with this material provides a softer surface than a tubular configuration, so that the roller surface is brought to a closer contact with the toner image to provide satisfactory fixing property. As compared with the conventional rollers of silicon rubber or fluoro rubber, this roller coated with fluororesin can be produced at a lower cost, thereby making it possible to achieve a reduction in cost.

Inside the fixing roller 51 and the pressurizing roller 52, there are arranged heaters 56 and 57 consisting of halogen lamps or the like (In some cases, the halogen heater 57 is not provided). Further, thermistors 58 and 59 are arranged so as to be in contact with the fixing roller 51 and the pressurizing roller 52, respectively. By controlling the voltage supplied to the heaters 56 and 57 through a temperature control circuit, the temperature of the surfaces of the fixing roller 51 and the pressurizing roller 52 is controlled.

Further, a cleaning device 54 is mounted to the fixing roller 51. By this cleaning device 54, toner, etc. offset onto the fixing roller 51 is removed.

The cleaning device 54 comprises a cleaning web 54*a* consisting of a strip-like heat resistant non woven fabric, a pressing roller 54*b* pressing the cleaning web 54*a* against the fixing roller 51, a feeding roller 54*c* feeding out new cleaning web 54*a,* a take-up roller 54*d* for gradually taking up the portion of the cleaning web 54*a* whose cleaning capacity has degenerated, etc. In particular, in order to prevent the offset toner from adhering to the thermistor 58 to cause defective detection in the thermistor 58, this cleaning device 54 is provided on the upstream side of the thermistor 58 with respect to the rotating direction of the fixing roller 51.

The taking up of the cleaning web 54*a* is effected as follows. When it is determined from the counter that a predetermined number of copies have been made, a solenoid (not shown) is turned on, and a one-way clutch operates, whereby a predetermined amount of web is taken up in the direction opposite to the rotating direction of the roller. By taking up the cleaning web 54*a* in the direction opposite to the rotating direction of the roller, the cleaning web 54*a* is prevented from being caught in the rotating direction of the roller.

Further, the pressurizing roller 52 is also provided with a cleaning device 55, which comprises a cleaning web 55*a,* a pressing roller 55*b,* a feeding roller 55*c,* a take-up roller 55*d,* etc. By this cleaning device, the toner adhering to the pressurizing roller 52 through the fixing roller 51 is removed (In some cases, the cleaning device 55 is not provided.)

When the transfer paper P is conveyed to the fuser, the fixing roller 51 and the pressurizing roller 52 rotate, and, when the recording material P passes between the fixing roller 51 and the pressurizing roller 52, the recording material P is pressurized and heated at a substantially constant pressure and temperature from the obverse and reverse sides, and the toner image on the paper is melted and fixed to thereby form a full color image on the recording material P. The transfer paper P to which the image has been transferred is separated by a separation claw 68, and discharged to the exterior of the apparatus.

Embodiments of the present invention will now be specifically described.

(First Embodiment)

First, a first embodiment of the present invention will be described with reference to FIG. 1 and Table 1.

FIG. 1 is a sectional view of a fixing roller to which the present invention is applied, and Table 1 shows the result of an experiment conducted by using the fixing roller of this embodiment.

In this embodiment, the ratio of the coefficient of linear expansion of the surface resin layer to the coefficient of linear expansion of the lower resin layer is set to a predetermined range, thereby preventing the generation of a crack. First, the fixing roller used in this embodiment will be described with reference to FIG. 1. The fixing roller used in this embodiment is formed by forming an HTV silicone rubber layer on a 5 mm Al core to a thickness of 0.5 to 3.5 mm, applying thereto PFA powder to a thickness of approximately 20 to 50 $\mu$m and performing firing thereon. The outer diameter is 40 mm. Regarding the lower HTV silicone rubber, its coefficient of linear expansion at 150° C. is set to be 3 to $5\times10E^{-4}$ cm/cm·° C. by varying the amount of filler. The pressurizing roller was formed by forming an HTV silicone rubber layer on a 5 mm Al core to a thickness of 1 mm, and forming a 50 $\mu$m PFA tube thereon. A pressurizing force of 40 kg was applied to the fixing roller and the pressurizing roller to examine the OHP sheet discharge property and crack generation. The results are shown in Table 1.

First, regarding the OHP sheet discharging property, a toner image formed on an OHP film consisting of 100 $\mu$m PET using toners of Y, M, C and Bk was conveyed to the fuser rotating at a fixing temperature of 150° C. and a fixing speed of 30 mm/sec to examine the discharging direction of the OHP sheet after the fixing. As a result, when the thickness of the lower elastic layer of the fixing roller is less than 1 mm, the OHP sheet was wound around the fixing roller and a satisfactory discharging was not conducted. A similar result was obtained when the thickness of the lower rubber layer of the pressurizing roller was smaller or larger than 1 mm. Thus, it was necessary to make the thickness of the lower elastic layer of the fixing roller not less than 1 mm to discharge OHP sheets in a satisfactory manner. Next, the coefficient of linear expansion of the lower elastic layer of the fixing roller was varied to examine crack generation. As the measuring method, a heat cycle test was repeated in which the power source is turned on to control temperature to 150° C. for 30 minutes and then cooled for 90 minutes. As a result, it turned out that no crack is generated when the coefficient of linear expansion of the lower elastic layer is smaller than 2.7 times the coefficient of linear expansion of the surface resin layer, with the thickness of the lower elastic layer of the fixing roller being not less than 1 mm.

The fixing temperature, speed, and pressurizing force in this embodiment vary according to the toner and mechanical construction, so that the above values are not to be construed restrictively. Further, while in this embodiment a fixing roller coated with PFA resin is used, a similar result can be obtained by using a roller coated with PTFE, FEP, etc. by spraying or the like.

TABLE 1

| | Surface resin | | Lower elastic layer | | | |
|---|---|---|---|---|---|---|
| | Coefficient of linear expansion (cm/cm ° C.) | Thickness (mm) | Coefficient of linear expansion (cm/cm ° C.) | Thickness (mm) | Crack generation | OHP discharge |
| 1 | 1.5 × 10E-4 | 0.02 | 5.0 × 10E-4 | 0.5 | ○ | x Winding |
| | | | | 1 | x | ○ |
| | | | | 2 | x | ○ |
| | | | | 3 | x | ○ |
| | | | | 3.5 | x | ○ |
| 2 | ↑ | ↑ | 4.0 × 10E-4 | 0.5 | ○ | x Winding |
| | | | | 1 | ○ | ○ |
| | | | | 2 | ○ | ○ |
| | | | | 3 | ○ | ○ |
| | | | | 3.5 | ○ | ○ |
| 3 | ↑ | ↑ | 3.0 × 10E-4 | 0.5 | ○ | x Winding |
| | | | | 1 | ○ | ○ |
| | | | | 2 | ○ | ○ |
| | | | | 3 | ○ | ○ |
| | | | | 3.5 | ○ | ○ |
| 4 | ↑ | 0.05 | 5.0 × 10E-4 | 0.5 | ○ | x Winding |
| | | | | 1 | x | ○ |
| | | | | 2 | x | ○ |
| | | | | 3 | x | ○ |
| | | | | 3.5 | x | ○ |
| 5 | ↑ | ↑ | 4.0 × 10E-4 | 0.5 | ○ | x Winding |
| | | | | 1 | ○ | ○ |
| | | | | 2 | ○ | ○ |
| | | | | 3 | ○ | ○ |
| | | | | 3.5 | ○ | ○ |
| 6 | ↑ | ↑ | 3.0 × 10E-4 | 0.5 | ○ | x Winding |
| | | | | 1 | ○ | ○ |
| | | | | 2 | ○ | ○ |
| | | | | 3 | ○ | ○ |
| | | | | 3.5 | ○ | ○ |

(Second Embodiment)

Next, the second embodiment of the present invention will be described with reference to FIG. 1 and Table 2.

FIG. 1 is a sectional view of a fixing roller according to the present invention, and Table 2 shows the result of an experiment conducted by using the fixing roller of this embodiment.

In this embodiment, generation of a crack when the ratio of the coefficient of linear expansion of the surface resin layer to that of the lower resin layer is outside a predetermined range is prevented. First, the fixing roller used in this embodiment will be described with reference to FIG. 1. In the fixing roller used in this embodiment, the coefficient of linear expansion of the lower elastic layer at 150° C. is not less than 2.7 times the coefficient of linear expansion of the surface resin layer, and the thickness of the surface resin layer is varied in the range 20 to 100 μm. The pressurizing roller used is the same as that in the first embodiment. Table 2 shows the results of an experiment conducted under the same conditions as in the first embodiment.

Referring to Table 2, when the coefficient of linear expansion of the lower layer at 150° C. is 2.7 to 3.4 times the coefficient of linear expansion of the surface resin layer, a crack is liable to be generated when the thickness of the lower elastic layer is large. However, when the thickness of the surface resin layer is increased, no crack is generated since deformation due to thermal expansion can be restrained by the surface resin layer. No crack will be generated by making the thickness of the surface resin layer 60 to 100 μm when the thickness of the lower elastic layer is in the range of 1 mm to 3 mm. The larger the thickness of the surface resin layer, the greater the crack prevention effect. However, it is desirable for its upper limit to be 100 μm from the viewpoint of heat conduction and production.

Due to this arrangement, there is no OHP sheet winding as in the first embodiment, and it is possible to prevent crack generation.

Further, this embodiment proves more effective when used in the case in which the coefficient of linear expansion of the elastic layer at 150° C. is not more than 2.7 times the coefficient of linear expansion of the resin layer at 150° C.

TABLE 2

| | Surface resin | | Lower elastic layer | | |
|---|---|---|---|---|---|
| | Coefficient of linear expansion (cm/cm ° C.) | Thickness (mm) | Coefficient of linear expansion (cm/cm ° C.) | Thickness (mm) | Crack generation |
| 1 | 1.5 × 10E-4 | 0.02 | 4.0 × 10E-4 | 0.5 | ○ |
| | | 0.05 | | | ○ |
| | | 0.06 | | | ○ |
| | | 0.1 | | | ○ |
| 2 | ↑ | 0.02 | ↑ | 1 | ○ |
| | | 0.05 | | | ○ |
| | | 0.06 | | | ○ |
| | | 0.1 | | | ○ |
| 3 | ↑ | 0.02 | ↑ | 3 | ○ |
| | | 0.05 | | | ○ |
| | | 0.06 | | | ○ |
| | | 0.1 | | | ○ |
| 4 | ↑ | 0.02 | ↑ | 3.5 | ○ |
| | | 0.05 | | | ○ |
| | | 0.06 | | | ○ |
| | | 0.1 | | | ○ |
| 5 | ↑ | 0.02 | 5.0 × 10E-4 | 2.5 | x |
| | | 0.05 | | | x |
| | | 0.06 | | | ○ |
| | | 0.1 | | | ○ |
| 6 | ↑ | 0.02 | ↑ | 3 | x |
| | | 0.05 | | | x |
| | | 0.06 | | | ○ |
| | | 0.1 | | | ○ |

(Third Embodiment)

Next, a third embodiment of the present invention will be described with reference to FIG. 2 and Table 3.

FIG. 2 is a sectional view of a fixing roller according to this invention, and Table 3 shows the results of an experiment conducted by using the fixing roller of this embodiment.

In this embodiment, generation of a crack when the ratio of the coefficient of linear expansion of the surface resin layer to the coefficient of linear expansion of the lower resin layer is outside a predetermined range is prevented. First, the fixing roller used in this embodiment will be described with reference to FIG. 2. In this embodiment, to prevent crack generation in a fixing roller in which the thickness of the lower elastic layer is not less than 1 mm and the coefficient of linear expansion of the lower elastic layer at 150° C. is not less than 2.6 times the coefficient of linear expansion of the surface resin layer and the thickness of the surface resin layer is not more than 50 μm, there is provided between the surface resin layer and the lower elastic layer at least one elastic layer having a coefficient of linear expansion which is somewhere between the coefficient of linear expansion of the surface resin layer and the coefficient of linear expansion of the lower elastic layer. The intermediate elastic layer used in this embodiment is an elastic layer consisting of a mixture of fluoro rubber and the PFA resin of the surface layer.

As in the first and second embodiments, a heat cycle test was conducted by using this fixing roller. The results are shown in Table 3. As shown in Table 3, by forming the intermediate elastic layer in the range of 0.01 mm to 0.1 mm, it is possible to prevent crack generation even under the condition in which the surface resin layer is 20 to 50 μm and the lower elastic layer is not less than 1 mm and in which the coefficient of linear expansion of the surface resin layer is not less than 2.7 times and not more than 3.4 times the coefficient of linear expansion of the lower elastic layer.

While in this embodiment the material of the intermediate elastic layer is a mixture of fluoro rubber and the PFA resin of the surface layer, this should not be construed restrictively. The elastic material alone will provide the same effect. The kind of elastic material is not restricted to fluoro rubber. Other elastic materials such as silicone rubber will provide the same effect as long as its coefficient of linear expansion is somewhere between the coefficient of linear expansion of the lower elastic layer and that of the surface resin layer. Further, while in this embodiment the intermediate elastic member consists of fluoro rubber and PFA resin, the resin is not retricted to PFA resin. PTF, PFA, etc. will provide the same effect. Further, while in this embodiment a single intermediate elastic layer is used, the same effect can be obtained when a plurality of intermediate elastic layers are provided.

This embodiment proves more effective when used in the case in which the coefficient of linear expansion of the elastic layer at 150° C. is not more than 2.7 times the coefficient of linear expansion of the resin layer at 150° C.

TABLE 3

| | Surface resin | | Lower elastic layer | | Intermediate elastic layer | | |
|---|---|---|---|---|---|---|---|
| | Coefficient of linear expansion (cm/cm ° C.) | Thickness (mm) | Coefficient of linear expansion (cm/cm ° C.) | Thickness (mm) | Coefficient of linear expansion (cm/cm° C.) | Thickness (mm) | Crack generation |
| 1 | 1.5 × 10E-4 | 0.02 | 5.0 × 10E-4 | 1 | 2.0 × 10E-4 | 0.01 | ○ |
| | | | | | | 0.05 | ○ |
| | | | | | | 0.1 | ○ |
| | | | | 3 | | 0.01 | ○ |
| | | | | | | 0.05 | ○ |
| | | | | | | 0.1 | ○ |
| 2 | ↑ | ↑ | ↑ | 1 | 4.0 × 10E-4 | 0.01 | ○ |
| | | | | | | 0.05 | ○ |
| | | | | | | 0.1 | ○ |
| | | | | 3 | | 0.01 | ○ |
| | | | | | | 0.05 | ○ |
| | | | | | | 0.1 | ○ |
| 3 | ↑ | 0.05 | ↑ | 1 | 2.0 × 10E-4 | 0.01 | ○ |
| | | | | | | 0.05 | ○ |
| | | | | | | 0.1 | ○ |
| | | | | 3 | | 0.01 | ○ |
| | | | | | | 0.05 | ○ |
| | | | | | | 0.1 | ○ |
| 4 | ↑ | ↑ | ↑ | 1 | 4.0 × 10E-4 | 0.01 | ○ |
| | | | | | | 0.05 | ○ |
| | | | | | | 0.1 | ○ |
| | | | | 3 | | 0.01 | ○ |
| | | | | | | 0.05 | ○ |
| | | | | | | 0.1 | ○ |

(Fourth Embodiment)

Next, the fourth embodiment of the present invention will be described with reference to Table 4.

Table 4 shows the results of an experiment conducted by using the fixing roller of this embodiment.

In this embodiment, generation of a crack when the ratio of the coefficient of linear expansion of the surface resin layer to that of the lower elastic layer is outside a predetermined range is prevented. As in the third embodiment, in this embodiment, an intermediate elastic layer is provided between the surface resin layer and the lower elastic layer. This embodiment differs from the third embodiment in that the hardness of this intermediate elastic layer is varied. First, the fixing roller used in this embodiment will be described. In this embodiment, to prevent crack generation in a fixing roller in which the thickness of the lower elastic layer is not less than 1 mm and the coefficient of linear expansion of the lower elastic layer at 150° C. is not less than 2.7 times the coefficient of linear expansion of the surface resin layer and the thickness of the surface resin layer is not more than 50 μm, there is provided between the surface resin layer and the lower elastic layer an elastic layer having a hardness not lower than a predetermined level of hardness. The material of the intermediate elastic layer used in this embodiment is a mixture of fluoro rubber and the PFA resin of the surface layer. Fixing rollers in which the hardness of this fluoro rubber is varied were prepared and an experiment was conducted. In this embodiment, by varying the amount of inorganic powder as the vulcanizing material, fluoro rubbers of different hardnesses were prepared and fixing rollers were obtained. Then, as in the first, second and third embodiments, a heat cycle test was conducted. The results are shown in Table 4. As shown in Table 4, by making the fluoro rubber hardness of the intermediate elastic layer not less than 75 degrees of JIS-A standard, it is possible to prevent crack generation even when the thickness range is 0.01 mm to 0.1 mm, the surface resin layer ranges from 20 to 50 μm, the lower elastic layer is not less than 1 mm, and the coefficient of linear expansion of the surface resin layer is not less than 2.7 times and not more than 3.4 times the coefficient of linear expansion of the lower elastic layer. While in this embodiment the material of the intermediate elastic layer is a mixture of fluoro rubber and the PFA resin of the surface layer, this should not be construed restrictively. An elastic material alone will provide the same effect as long as its hardness is not less than 75 degrees of JIS-A standard. The kind of elastic material is not restricted to fluoro rubber. Further, while in this embodiment fluoro rubber and PFA resin are used in the intermediate elastic material, the resin is not restricted to PFA resin. PTFE, PFA, etc. will provide the same effect. Further, while in this embodiment a single intermediate elastic layer is used, the same effect can be obtained if a plurality of intermediate elastic layers are provided.

This embodiment proves more effective when used in the case in which the coefficient of linear expansion of the elastic layer at 150° C. is not more than 2.7 times the coefficient of linear expansion of the resin layer at 150° C.

TABLE 4

| | Surface resin | | Lower elastic layer | | | | |
|---|---|---|---|---|---|---|---|
| | Coefficient of linear expansion (cm/cm ° C.) | Thickness (mm) | Coefficient of linear expansion (cm/cm ° C.) | Thickness (mm) | Intermediate elastic layer Rubber hardness | Intermediate elastic layer Thickness (mm) | Crack generation |
| 1 | 1.5 × 10E-4 | 0.02 | 5.0 × 10E-4 | 1 | 70° | 0.01 | X |
| | | | | | | 0.05 | ○ |
| | | | | | | 0.1 | ○ |
| | | | | 3 | | 0.01 | X |
| | | | | | | 0.05 | X |
| | | | | | | 0.1 | ○ |
| 2 | ↑ | ↑ | ↑ | 1 | 73° | 0.01 | ○ |
| | | | | | | 0.05 | ○ |
| | | | | | | 0.1 | ○ |
| | | | | 3 | | 0.01 | X |
| | | | | | | 0.05 | ○ |
| | | | | | | 0.1 | ○ |
| 3 | ↑ | 0.05 | ↑ | 1 | 75° | 0.01 | ○ |
| | | | | | | 0.05 | ○ |
| | | | | | | 0.1 | ○ |
| | | | | 3 | | 0.01 | ○ |
| | | | | | | 0.05 | ○ |
| | | | | | | 0.1 | ○ |
| 4 | ↑ | ↑ | ↑ | 1 | 77° | 0.01 | ○ |
| | | | | | | 0.05 | ○ |
| | | | | | | 0.1 | ○ |
| | | | | 3 | | 0.01 | ○ |
| | | | | | | 0.05 | ○ |
| | | | | | | 0.1 | ○ |
| 4 | ↑ | ↑ | ↑ | 1 | 80° | 0.01 | ○ |
| | | | | | | 0.05 | ○ |
| | | | | | | 0.1 | ○ |
| | | | | 3 | | 0.01 | ○ |
| | | | | | | 0.05 | ○ |
| | | | | | | 0.1 | ○ |

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A fuser of the type which has a pair of rollers which are arranged so as to be rotatable while being in press contact with each other and which consist of a fixing roller and a pressurizing roller, a recording material having an image which has not undergone fixing being press-conveyed by a pressurizing portion formed by the pair of rollers to effect heat fixing of the image on the recording material, wherein the fixing roller has an elastic layer having a thickness of 1 mm or more and a resin layer having a thickness of 20 $\mu$m to 50 $\mu$m formed on the surface of the elastic layer by firing, and wherein the coefficient of linear expansion of the elastic layer at 150° C. is not larger than 2.7 times the coefficient of linear expansion of the resin layer at 150° C.

2. A fuser according to claim 1, wherein the coefficient of linear expansion of the elastic layer at 150° C. is not larger than $4.0\times10E^{-4}$ cm/cm·° C.

3. A fuser of the type which has a pair of rollers which are arranged so as to be rotatable while being in press contact with each other and which consist of a fixing roller and a pressurizing roller, a recording material having an image which has not undergone fixing being press-conveyed by a pressurizing portion formed by the pair of rollers to effect heat fixing of the image on the recording material, wherein the fixing roller has a first elastic layer having a thickness of 1 mm or more and a resin layer having a thickness of 20 $\mu$m to 50 $\mu$m formed on the surface of the first elastic layer by firing, wherein there is provided between the first elastic layer and the resin layer at least one other elastic layer having a coefficient of linear expansion which is somewhere between the coefficient of linear expansion of the first elastic layer at 150° C. and the coefficient of linear expansion of the resin layer at 150° C., and wherein the coefficient of linear expansion of an adjacent inner layer at 150° C. is not larger than 2.7 times the coefficient of linear expansion of an adjacent outer layer at 150° C.

4. A fuser according to claim 3, wherein the coefficient of linear expansion at 150° C. of the first elastic layer spaced apart from the resin layer is not less than 2.7 times and not more than 3.4 times the coefficient of linear expansion of the resin layer at 150° C. and wherein the coefficient of linear expansion of the at least one other elastic layer adjacent to the resin layer is not more than $4.0\times10E^{-4}$ cm/cm° C.

5. An image forming apparatus which is equipped with a fuser as claimed in any one of claims 1, 2, 3, or 4.

* * * * *

UNITED STATES PATENT AND TRADEMARK OFFICE

CERTIFICATE OF CORRECTION

PATENT NO. : 6,219,522 B1
DATED : April 17, 2001
INVENTOR(S) : Jiro Ishizuka et al.

It is certified that error appears in the above-identified patent and that said Letters Patent is hereby corrected as shown below:

Column 7,
Line 3, “the” should read -- of the --.
Line 66, “aspect” should read -- aspects --.

Column 9,
Line 52, “removed” should read -- removed. --.

Signed and Sealed this

Eighteenth Day of November, 2003

JAMES E. ROGAN
*Director of the United States Patent and Trademark Office*